US006669188B1

(12) United States Patent
Marasco et al.

(10) Patent No.: US 6,669,188 B1
(45) Date of Patent: Dec. 30, 2003

(54) MULTI-POSITIONAL, ROTATABLE/LARGE SUBSTRATE BACKSTOP GUIDE

(75) Inventors: Joseph Marasco, Fairport, NY (US); Eugene F. Miller, Fairport, NY (US); William D. Milillo, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/213,746

(22) Filed: Aug. 6, 2002

(51) Int. Cl.[7] ..... B65H 1/00
(52) U.S. Cl. ..... 271/171; 271/145; 271/170
(58) Field of Search ..... 271/171, 170, 271/169, 145

(56) References Cited

U.S. PATENT DOCUMENTS 3,847,387 A * 11/1974 Sick ..... 271/171
3,921,972 A * 11/1975 Miller ..... 271/171
4,505,575 A 3/1985 Palumbo
4,607,834 A 8/1986 Dastin
4,786,042 A * 11/1988 Stemmle ..... 271/9.1
5,332,209 A 7/1994 Romansky et al.

FOREIGN PATENT DOCUMENTS

JP 04197967 A * 7/1992 ..... B65H/83/02

* cited by examiner

*Primary Examiner*—Donald P. Walsh
*Assistant Examiner*—Kaitlin Joerger
(74) *Attorney, Agent, or Firm*—W. Henry, III

(57) ABSTRACT

A substrate tray includes a tall backstop guide that is attached to the bottom of the feed tray and which rotates about a vertical axis into three positions 45° apart, presenting four different surfaces to a stack of substrates in the tray. Each surface accommodates a different substrate size and thereby accommodates four different widths of substrates. The backstop guide includes a cam member that is flexed against a back wall of the tray when a load is applied to the backstop guide by the stack of substrates shifting inboard if the tray is pushed to forcefully into a machine after loading, in order to prevent skewing of the substrates.

18 Claims, 4 Drawing Sheets

MULTI-POSITIONAL, ROTATABLE/LARGE SUBSTRATE BACKSTOP GUIDE

BACKGROUND OF THE INVENTION

1. Field of the Invention

This invention relates generally to handling of substrates and, in particular, to a multi-positional, rotatable/large substrate backstop guide for a tray that holds substrates of different widths and lengths for feeding within a printing machine.

2. Description of Related Art

In a typical printer/copier, one or more suitable trays for supporting stacks of substrates or sheets are provided with the sheets being fed, in seriatim, therefrom. These trays rely on guides prior to feeding to align the sheets and may include side and rear guides adapted to engage the side edge portion and rear edge portion of a sheet stack. Usually, a pair of sheet guides is provided for locating and retaining the sheets in predetermined feeding position normal to the direction of sheet feed. A sheet stop locates the sheets in the sheet feeding direction.

For example, a tray adapted to support a stack of sheets is shown in U.S. Pat. No. 4,607,834 issued Aug. 26, 1986 to Richard M. Dastin that is adjustable to accommodate stacks of sheet material of different widths and lengths. The rear registration and the side registration surfaces are moved in unison with one another so as to engage the rear and side edges of the stack of sheet material respectively.

In FIGS. 4 and 5 of U.S. Pat. No. 4,505,575 to Stephen A. J. Palumbo, issued Mar. 19, 1985 main and auxiliary paper trays are disclosed that include a movable sheet elevator or base onto which a stack-like supply of copy sheets may be placed for use by a copier or printer. A pair of movable sheet guides is provided for locating and retaining the copy sheets in a predetermined feeding position normal to the direction of sheet feed. A fixed stop member is located in the rear of each paper tray in order to locate the copy sheets in the sheet feeding direction.

A self-centering adjustable feed tray assembly is disclosed in U.S. Pat. No. 5,332,209 issued Jul. 26, 1994 that includes a pair of edge guides opposedly arranged about the centerline of the tray. Movement of one of the edge guides results in the corresponding movement of the other about the centerline. With the use of a clutch disc, either paper guide may be moved independently of the other effectively changing the centerline relative to the feed path of a transport.

Even though the above-mentioned adjustable substrate trays are useful, there is still a need for a tray that can supply edge support near the back edge of large sheet stacks, for example, 11"×17" or larger in order to prevent the trail edge of large size substrates from rotating while the tray is being closed with too much force. Rotation of the substrates would cause their lead edges to be skewed, giving a higher probability of a substrate jam. The conventional edge guide does not extend back far enough to provide support in this area. Typically, this edge support function is attempted by using a fixed support which can only accommodate two paper sizes (11"×17" and A3) or a sliding guide that is difficult to access. However, the rear guide cannot be made wider to support wider substrates such as 11", A3, 12" & 12.6" because of close proximity to another assembly within a copier/printer. A molded stop feature is not feasible because 12" and 12.6" wide substrates have a larger width/length ratio.

SUMMARY OF THE INVENTION

Accordingly, pursuant to the features of the present invention, an improved substrate feed tray is disclosed that answers the above-mentioned problems by providing a tall backstop guide that is attached to the bottom of the feed tray and which rotates about a vertical axis into three positions 45° apart, presenting a different surface to a stack of substrates in the tray in each of two positions and two different surfaces to a stack of substrates in a third of the three positions of the backstop guide. Each surface accommodates a different substrate size and thereby accommodates four different widths of substrates. The backstop guide includes a cam member that is positioned in close proximity to a back wall of the tray and is adapted to be flexed into the back wall of the tray when a load is applied to the backstop guide by the stack of substrates shifting inboard due to excessive tray closing force being applied to the tray by an operator. Thus, the excess force will be transmitted to the tray's back wall. Also, by rotating instead of sliding, the backstop guide of the present invention makes it easy to change positions with no binding, and is easy to access and manipulate by grasping the top of the guide.

These and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
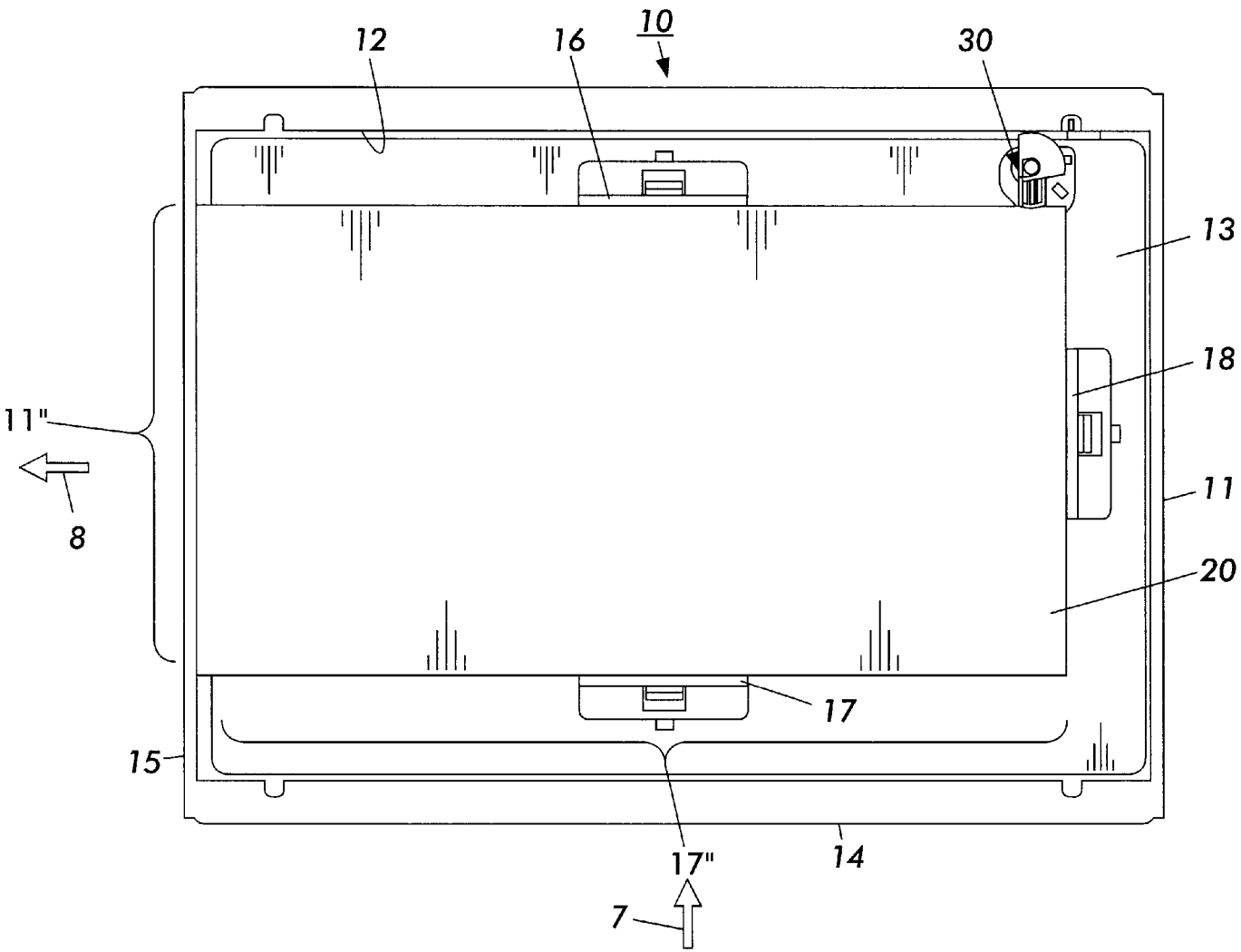
FIG. 1 is a schematic plan view of a substrate tray employing the multi-positional, rotatable/large substrate backstop guide of the present invention therein.

For a general understanding of the features of the present invention, reference is made to the drawings. In the drawings, like reference numerals have been used throughout to identify identical elements. FIG. 1 schematically depicts a plan view illustrating a tray that supports substrates or sheets for feeding within a machine for further processing, such as, a copier/printer and incorporating the features of the present invention therein. It will become evident from the following discussion that the multi-positional, rotatable/large substrate backstop guide of the present invention may be employed in a wide variety of trays and machines and in not specifically limited in its application to the particular tray or machines specifically mentioned herein.

Referring now to FIG. 1, there is shown a plan view illustrating a substrate tray 10 that is adapted to be loaded with a stack of substrates and pushed in the direction of arrow 7 in order to position the substrates into a center registration machine for feeding the substrates out of the tray by conventional means (not shown) in the direction of arrow 8. As shown, substrate tray 10 includes a back wall 12, a front wall 14, a side wall 11 and a registration wall 15. A moveable base member 13 is positioned within the walls of the tray and is raised by an elevator (not shown) to predetermined positions so that the topmost substrate in a stack of substrates positioned thereon can be fed therefrom over registration wall 15. Substrates are loaded into the tray by positioning them between adjustable rear (inboard) edge guide 16, front (outboard) edge guide 17, and trail edge guide 18. In addition, as will be explained in detail hereinafter, and accordance with the present invention, a multi-positional, rotatable/large substrate guide 30 is shown positioning 11"×17" substrates 20 for feeding in FIG. 1.

A machine, such as a conventional copier or printer, with a center registration system, requires two movable edge guides that align and register the substrates at a preferred location on movable base member 13 of FIG. 1. Thus, rear edge guide 16 has a generally planar surface, normal to base member 13, adapted to contact one side edge of substrates 20. Edge guide 16 is mounted slidably on base member 13 and moved in the direction of edge guide 17. Similarly, edge guide 17 engages the other edge of substrates 20. Edge guide 17 has a generally planar surface, normal to base member 13, in engagement with the other side edge of substrates 20. Edge guide 17 is also mounted slidably on base member 13 to move in the direction of edge guide 16. The distance between edge guide 16 and edge guide 17 corresponds to the width of the substrates supported on base member 13. Edge guide 16 and edge guide 17 move in unison with one another and are adapted to move either inwardly toward one another or outwardly away from one another depending upon the size of the substrates being supported on base member 13. In addition to edge guides 16 and 17, the substrates must be properly positioned lengthwise with respect to base member 13. This is achieved by use of rear guide 18. Rear guide 18 is mounted slidably on base member 13 to move in the direction of arrow 8. In this way, the length of the area on base member 13 may be adjusted so as to correspond to the length of the substrates 20 supported thereon. Rear guide 18 has a generally planar surface, normal to base member 13 and to the planar surfaces of edge guides 16 and 17, adapted to be in engagement with the rear edges of substrates 20. In this way, substrates 20 are positioned lengthwise so as to be in a substrate feeding position. Conventionally, a suitable stepper motor and cam member can be employed to automatically position edge guides 16 and 17 and rear guide 18, if desired.

Figure 2:
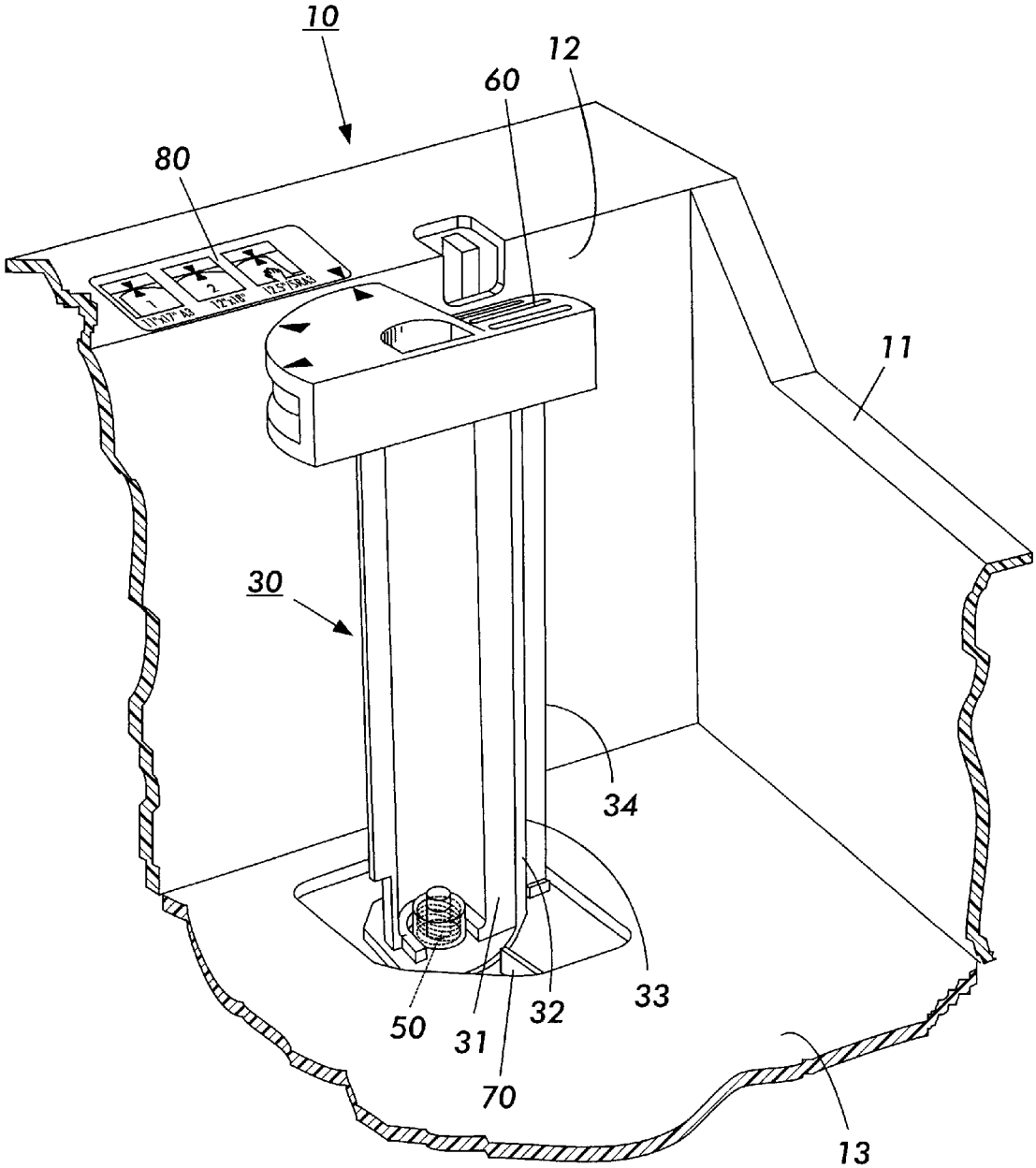
FIG. 2 is an enlarged, partial schematic elevational view of the substrate tray of FIG. 1 with the multi-positional, rotatable/large substrate backstop guide of the present invention located therein and positioned in one of three positions.

In FIG. 2, and in accordance with the present invention, a multi-positional, rotatable/large substrate backstop guide 30 is positioned next to backstop or back wall 12 in order to prevent the trail edge of large size substrates from rotating while the tray is being closed by an operator in the direction of arrow 7 of FIG. 1 with too much force. Backstop guide 30 prevents rotation of the substrates that will likely cause a substrate jam within the machine, thereby necessitating unwanted machine operator intervention. Backstop guide 30 is attached to the bottom of tray 10 and rotates about a vertical axis into three positions 45° apart, presenting one of four surfaces 31, 32, 33, or 34 to the substrates. Each surface accommodates a different substrate size. For example, surface 31 accommodates substrates that are 12.5" and 12.6" wide, surface 32 accommodates substrates 12" wide, while surface 33 is used with A3 size substrates and surface 34 is used when substrates 11" in width are required.

Figure 3:
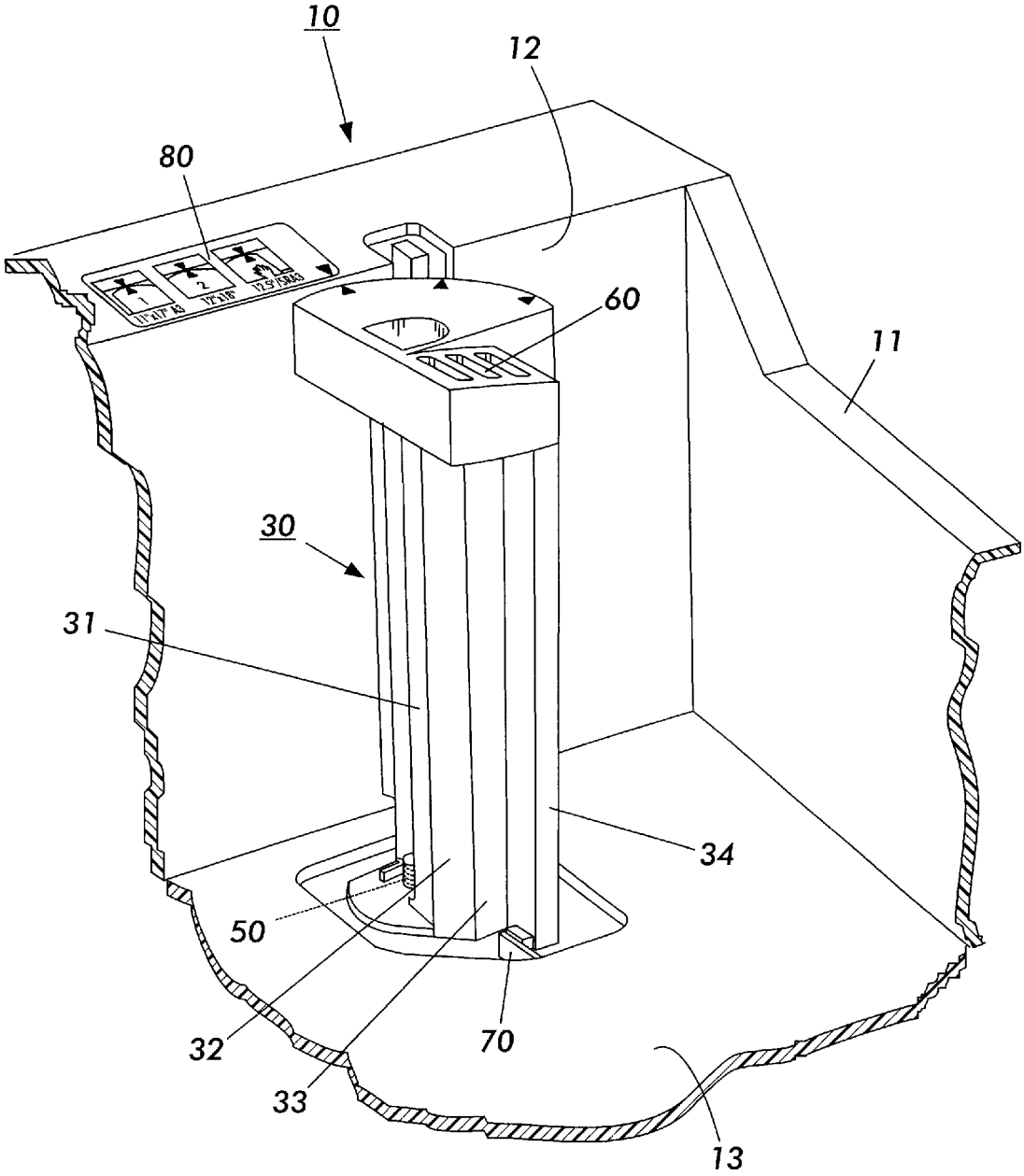
FIG. 3 is an enlarged, partial schematic elevational view of the substrate tray of FIG. 1 showing the multi-positional, rotatable/large substrate backstop guide of the present invention positioned in a second of three positions.
Figure 4:
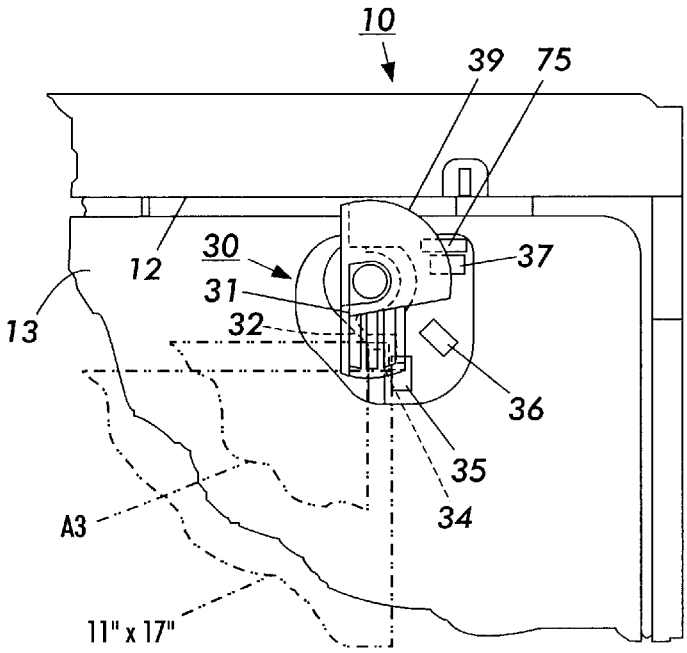
FIG. 4 is a partial schematic plan view of the backstop guide of FIG. 1 showing a cam member that cushions the backstop guide in the event of movement against a back wall of the tray.
Figure 5:
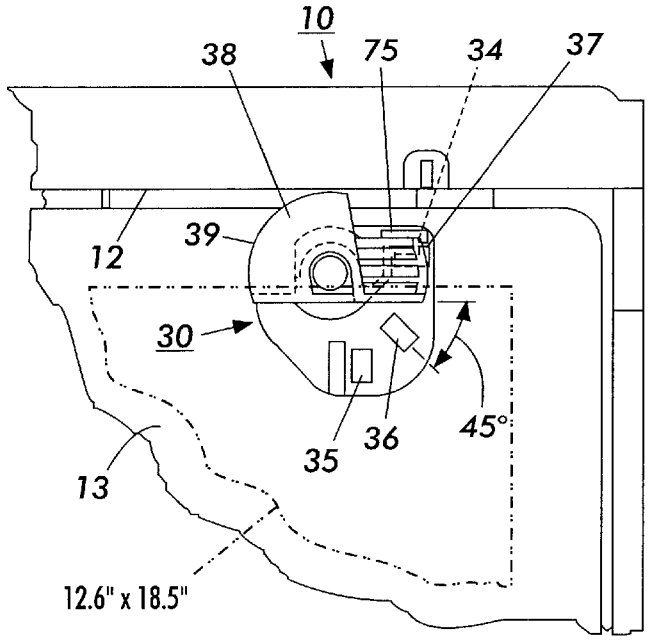
FIG. 5 is a partial schematic plan view of the backstop guide shown in FIG. 1 and shows various detent positions for the backstop guide.

As shown in FIGS. 2 and 3, backstop guide 30 is rotatably adjustable about a vertical axis and is biased against rotation by a compression spring 50. An advantage of backstop guide 30 is that it is easy to access and rotate into any one of three positions without binding occurring by grasping handle portion 60 of the backstop guide and turning it in a clockwise or counter-clockwise direction. A graphics label 80, as shown in FIGS. 2 and 3, on tray 10, as well as, graphics on the top of backstop guide 30 will instruct an operator where the backstop guide should be rotated to accommodate various substrate sizes (i.e., 11", A3, 12" and 12.6"). Backstop guide 30 is spaced a minimal distance from back wall 12 and includes a cam member 38 shown in FIGS. 4 and 5, that allows the backstop guide to rest against back wall 12 of tray 10 if an operator shoves the tray into a machine with enough force to shift substrates against the guide. Cam member 38 includes a curved portion 39 that facilitates contact with back wall 12 in any position backstop guide 30 is rotated, if substrate shifting occurs for any reason. When a load is applied to the backstop guide by a stack of substrates shifting inboard, any forces will be transmitted to the tray back wall 12, thus registering the substrates and minimizing skewing of the substrate stack and preventing jams. In FIG. 4, backstop guide 30 is shown positioned to accept A3 and 11"×17" substrates. A stop member 70, shown in FIG. 1, prevents over rotating guide 30 in a clockwise direction and stop member 75, shown in FIG. 4, prevents over rotating the guide in a counter clockwise direction.

An operator positions backstop guide 30 by grasping handle portion 60 and rotating the guide into any one of three detent positions that are molded into tray 10. For example, in FIG. 5., detents 35, 36 and 37 are shown with the backstop guide 30 being positioned to accept 12.6"× 18.5" substrates. A Protruding member (not shown) extends from a bottom surface of backstop guide 30 and is adapted to fit into any one of the multiple detents in order to stabilize the guide in any one of predetermined positions. The detents are 45° apart. Backstop guide 30 is held in each detent position by conventional means, such as, a compression spring 50.

It should now be understood that a simple, low cost substrate guide has been disclosed that is compact and accommodates various substrate widths. The substrate guide is attached to the bottom of a tray and rotates about a vertical axis into one of three positions 45° apart and thereby being able to present multiple registration surfaces to different substrate stacks placed into the tray. Each of two of the three positions accommodate different substrate sizes while the third position accommodates two different substrate sizes and a cam portion of the substrate guide is adapted to flex into contact with a back wall of the tray to prevent rotation or skewing of the substrate stack if the tray is pushed into a machine with too much force.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A tray for holding a stack of substrates and being adjustable to accommodate substrates of different lengths and widths, including:

a base member for supporting the stack of substrates thereon;

a back wall connected to said tray; and a backstop guide adapted to provide registration for a rear edge of the stack of substrates, and wherein said backstop guide is rotatable and adapted to flex against said back wall of said tray when substrates are shifted against it.

2. The apparatus of claim 1, wherein said backstop guide includes multiple surfaces for contacting substrates of different widths.

3. The apparatus of claim 2, wherein said backstop guide has a portion thereof closely spaced from said back wall of said tray.

4. The apparatus of claim 3, wherein said portion of said backstop guide that is closely spaced from said back wall is a cam.

5. The apparatus of claim 4, wherein said cam is curved.

6. The apparatus of claim 1, wherein said backstop guide is adapted to rotate into multiple positions 45° apart.

7. The apparatus of claim 6, wherein said backstop guide is attached to the bottom of said tray and is adapted to rotate about a vertical axis into three positions 45° apart and thereby presenting one of four different surfaces to the substrate stack.

8. The apparatus of claim 7, wherein each of said surfaces of said backstop guide accommodates a different substrate size.

9. The apparatus of claim 8, wherein said tray includes detents for different substrate sizes, and wherein said backstop guide is biased into said detents.

10. The apparatus of claim 9, wherein said detents are 45° apart.

11. The apparatus of claim 1, wherein said backstop guide is biased.

12. The apparatus of claim 11, wherein said backstop is biased by a compression spring.

13. A multi-positional, rotatable, substrate backstop guide adjustable to accommodate substrate stacks of different widths, comprising:

a guide member, said guide member including multiple surfaces for contacting and registering substrates of different widths; and wherein said guide member includes a cam member, said cam member being adapted to flex due to substrates shifting thereagainst.

14. The apparatus of claim 11, wherein guide member is biased.

15. The apparatus of claim 13, wherein said guide member is adapted to rotate into positions 45° apart.

16. The apparatus of claim 15, wherein said guide member is adapted to rotate about a vertical axis into three positions 45° apart to thereby present one of multiple surfaces to a substrate stack.

17. The apparatus of claim 16, wherein each of said multiple surfaces of said guide member accommodate a different substrate size.

18. The apparatus of claim 14, wherein said guide member is biased by a compression spring.

* * * * *